US006382523B1

(12) United States Patent
Hedegard

(10) Patent No.: US 6,382,523 B1
(45) Date of Patent: May 7, 2002

(54) ROAD BRINE SPREADER

(76) Inventor: Albert Hedegard, Lille Hedegardsvej 2, Borbjerg, 7500 (DK)

( * ) Notice: Subject to any disclaimer, the term of this patent is extended or adjusted under 35 U.S.C. 154(b) by 0 days.

(21) Appl. No.: 09/529,818

(22) PCT Filed: Oct. 21, 1998

(86) PCT No.: PCT/DK98/00458

§ 371 Date: Jul. 18, 2000

§ 102(e) Date: Jul. 18, 2000

(87) PCT Pub. No.: WO99/22076

PCT Pub. Date: May 6, 1999

(30) Foreign Application Priority Data

Oct. 23, 1997 (DK) ..... 1207/97

(51) Int. Cl.[7] ..... A01G 25/09

(52) U.S. Cl. ..... 239/172; 239/69; 239/73; 239/161; 239/164; 239/169; 239/550; 239/562; 239/566

(58) Field of Search ..... 239/69, 71, 73, 239/160, 161, 162, 163, 164, 166, 169, 170, 172, 176, 550, 562, 566

(56) References Cited

U.S. PATENT DOCUMENTS

| | | | | |
|---|---|---|---|---|
| 1,623,778 A | | 4/1927 | Cooke | |
| 2,681,828 A | | 6/1954 | Pollard | |
| 4,161,280 A | * | 7/1979 | Kasinskas | 239/172 X |
| 4,315,602 A | | 2/1982 | Kubacak et al. | |
| 4,817,870 A | * | 4/1989 | Dalton | 239/166 X |
| 5,004,156 A | * | 4/1991 | Montanier | 239/161 X |
| 5,904,296 A | * | 5/1999 | Doherty et al. | 239/69 X |
| 6,010,079 A | * | 1/2000 | Mayfield, Jr. et al. | 239/172 X |

FOREIGN PATENT DOCUMENTS

| | | |
|---|---|---|
| DE | 1 301 356 | 8/1969 |
| DE | 2 218 685 | 10/1972 |
| DE | 2 162 109 | 6/1973 |
| DK | 96 00202 | 8/1996 |
| EP | 0 835 962 | 4/1998 |
| FR | 2 339 020 | 8/1977 |
| FR | 2 665 717 | 2/1992 |
| WO | WO97/13926 | 4/1997 |

* cited by examiner

*Primary Examiner*—Steven J. Ganey
(74) *Attorney, Agent, or Firm*—McCormick, Paulding & Huber LLP

(57) ABSTRACT

A road brine spreader serving for driving along a road or a similar carriageway and within the roadsides, under pressure spreading out brine over the road via a number of liquid nozzles. The nozzles are arranged to send out the water in the form of jets. The spreader has a control system comprising a regulation mechanism for altering the water pressure and/or quantity and/or the angular position of at least some of the nozzles, and an actuating mechanism for actuating the regulation mechanism. The brine can with this device be spread evenly and uniformly over an iced up and/or snowed up roadway without passing the roadsides.

11 Claims, 3 Drawing Sheets

ROAD BRINE SPREADER

BACKGROUND ART

The invention relates to a road brine spreader for driving along a road or a similar carriageway and within a border area, such as a roadside, under pressure spreading brine out over the road via a number of liquid nozzles.

In many countries, it is a perpetually recurrent problem that the friction of the roadway surfaces is reduced substantially by ice and snow when the temperature falls below freezing point. Thereby, the roads become slippery and dangerous to drive on to the wheeled traffic.

A very widespread method to reduce the risk of traffic accidents on icy roads consists in spreading brine over the roadways from a vehicle with a rotating plate for spreading the brine.

It has turned out that less brine can be used with the same result when it is spread in an aqueous solution. For this purpose, a road brine spreader can advantageously be used which, just as field sprayers, operates with liquid nozzles for, under pressure, spreading the water over the roadways. The liquid nozzles are conventionally of the kind which spray the brine out in a conical form whereby the water is evenly and uniformly spread across the roadway. On the other hand, it is difficult or almost impossible to avoid that brine is also spread beyond the border areas which thereby risk being more or less damaged. Thus, grass and plants on sides or edges of ditches along the roads can hardly stand being sprayed by brine, which furthermore constitutes an additional cost of the brining of the roadway proper.

SUMMARY OF THE INVENTION

The object of the invention is to provide a road brine spreader of the kind mentioned in the opening paragraph whereby brine can be spread evenly and uniformly over an iced up and/or snowed up roadway without at the same time being spread over the border areas.

The novel and unique features according to the invention, whereby this is achieved, is the fact that the nozzles are arranged to send out water in the form of jets, and that the sprayer has a control system comprising regulation means for altering the water pressure and/or quantity and/or the angular position of at least some of the nozzles, and actuating means for actuating the regulation means.

The water jets form a concentrated water flow that easily and securely can be effectively controlled so that it is only the actual roadway which is hit by the jets. The border areas are therefore kept clear of brining. On meeting the roadway, the jets furthermore splash out so that the water is evenly spread over the roadway.

In an advantageous embodiment, there can, on each side of the road brine spreader, be placed an elongated side manifold each having a number of side nozzles for sending out water jets transversely to or slantwise of the direction of travel of the sprayer, and when the side manifold furthermore is pivotally mounted, the sprayer is, with a suitable manual or automatic control, able to send out water jets exactly to the roadside and no further.

When the angle formed by the direction in which the side nozzles send out jets and a horizontal plane is increasing nozzle by nozzle along the side manifold, the liquid jets hit the roadway in an evenly spread manner in a zone extending inwards from the border area.

The above control can advantageously be achieved by means of an automatically functioning control system which comprises a preprogrammed computer and different kinds of detectors for registering the parameters which, while driving along the road, affect the spraying process and as input to the computer, form the basis of computation of output for making the actuating means of the sprayer actuate the regulation means for optimum regulation of the different operating parameters of the sprayer.

The detectors can be of any suitable kind, such as laser detectors, ultrasonic detectors, or camera detectors. The wanted input for the computer can also come from a live wire which is lying along the roadside and is sending current to an ammeter when the outermost water jet gets too close to the wire.

Furthermore, the computer can expediently be arranged to store input received during driving in one direction and use these input to form output for optimum regulation of the operating parameters when driving in the opposite direction.

Finally, it is an advantage when the control system comprises a Global Position System (GPS) for via a satellite registering the character of the present position of the vehicle. Thereby, the spreader is enabled to automatically adapt the spread brine quantity to the local conditions which e.g. might be a bridge, a curve, or a stretch of forest.

It is furthermore an advantage when the control system comprises measuring of the resultant wind velocity and direction for regulation of the different operating parameters in order to thereby compensate for the effect of the resultant wind velocity on the course of the spreading.

BRIEF DESCRIPTION OF THE DRAWINGS

The invention will be explained in greater detail below, describing only exemplary embodiments with reference to the drawing, in which.

DETAILED DESCRIPTION OF PREFERRED EMBODIMENTS

Figure 1:
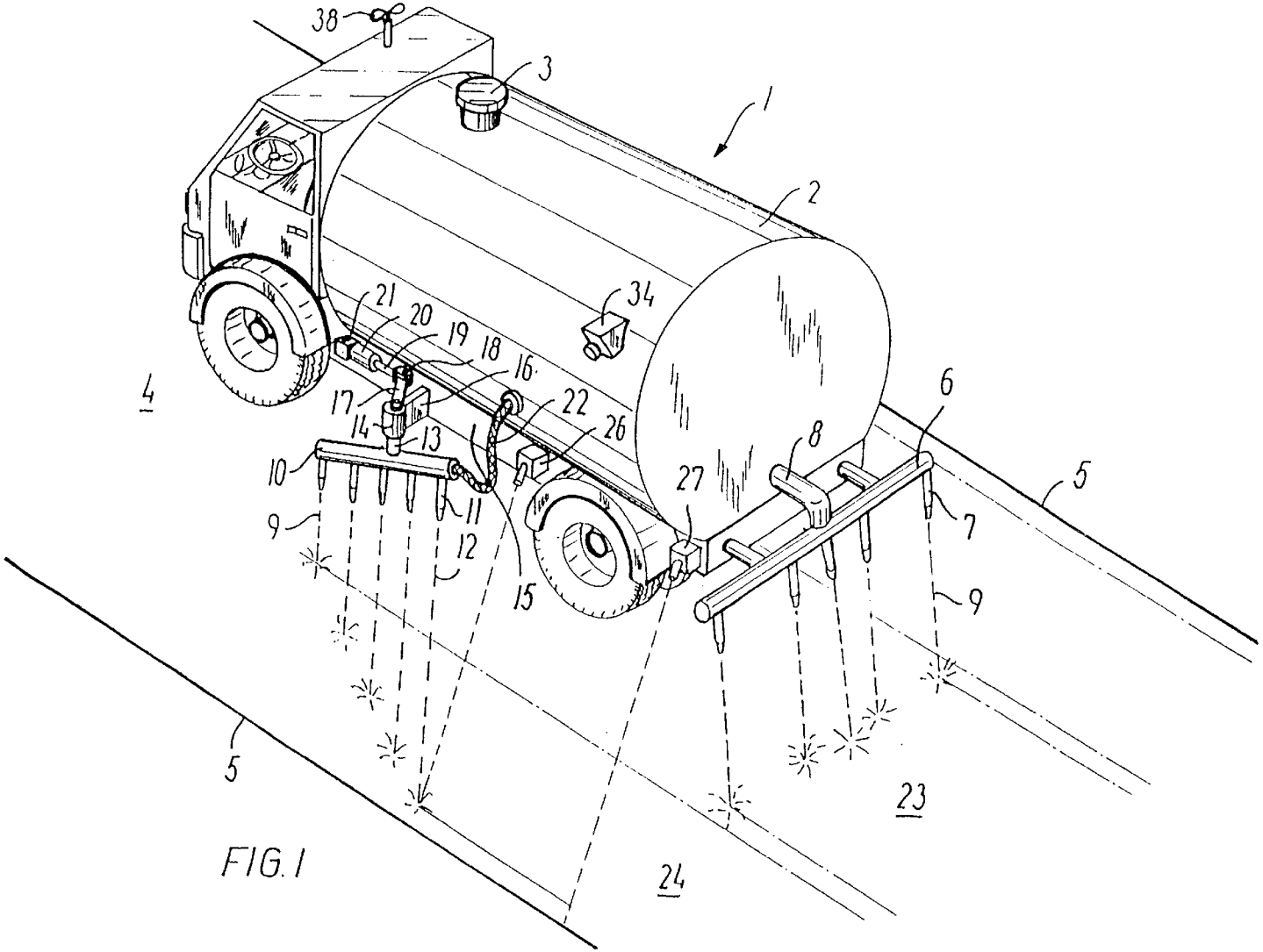
FIG. 1 is a perspective view of a road brine spreader according to the invention.

FIG. 1 shows a road brine spreader designated in general by the reference numeral 1. In the shown case, the road brine spreader is a tanker 1 with a tank 2 which, via a filling branch 3, has been filled with brine. The vehicle is driving on a roadway 4 delimited at roadsides 5 by e.g. a grass border (not shown) or a crash barrier (not shown).

On the back of the vehicle is placed a central manifold 6 with a plurality of central nozzles 7. In the preferred embodiment of the present invention, five central nozzles 7 are used. A force pump (not shown) placed in the tank 2 sends out brine under pressure of e.g. two bar through the central nozzles 7 via a pipe 8. The water leaves the nozzles 7 in the form of water jets 9 which splash out on meeting the roadway 4 so that the water is spread over an area far bigger than the area corresponding to the jet diameter.

On each side of the vehicle is placed a side manifold 10 with five side nozzles 11 that send out the water jets 9. The outermost of these water jets is designated by the reference numeral 12. On the side manifold is placed a mainly vertical shaft 13 which is pivotally journaled in a bearing tube 14 secured to the chassis 15 of the vehicle by means of a bracket 16. At the top, the shaft 13 has a transverse arm 17 which via a swivel 18 is connected with the piston rod 19 in a hydraulic or pneumatic cylinder 20 which again is pivotally mounted on the chassis with a swivel 21. A force pump (not shown) placed in the tank 2 sends out brine under a pressure of e.g. two bar through the side nozzles 11 via a flexible hose 22.

When the tanker 1 is operating and driving along the road, the central nozzles 7 cover a central track 23 with brine while the side nozzles 11 cover a side track 24. As the water jets 9 splash out in an area on the roadway that is larger than the jet itself, the space between the tracks 23 and 24 is also covered with brine and the brine also reaches to a wanted distance from the roadside 5.

Figure 2:
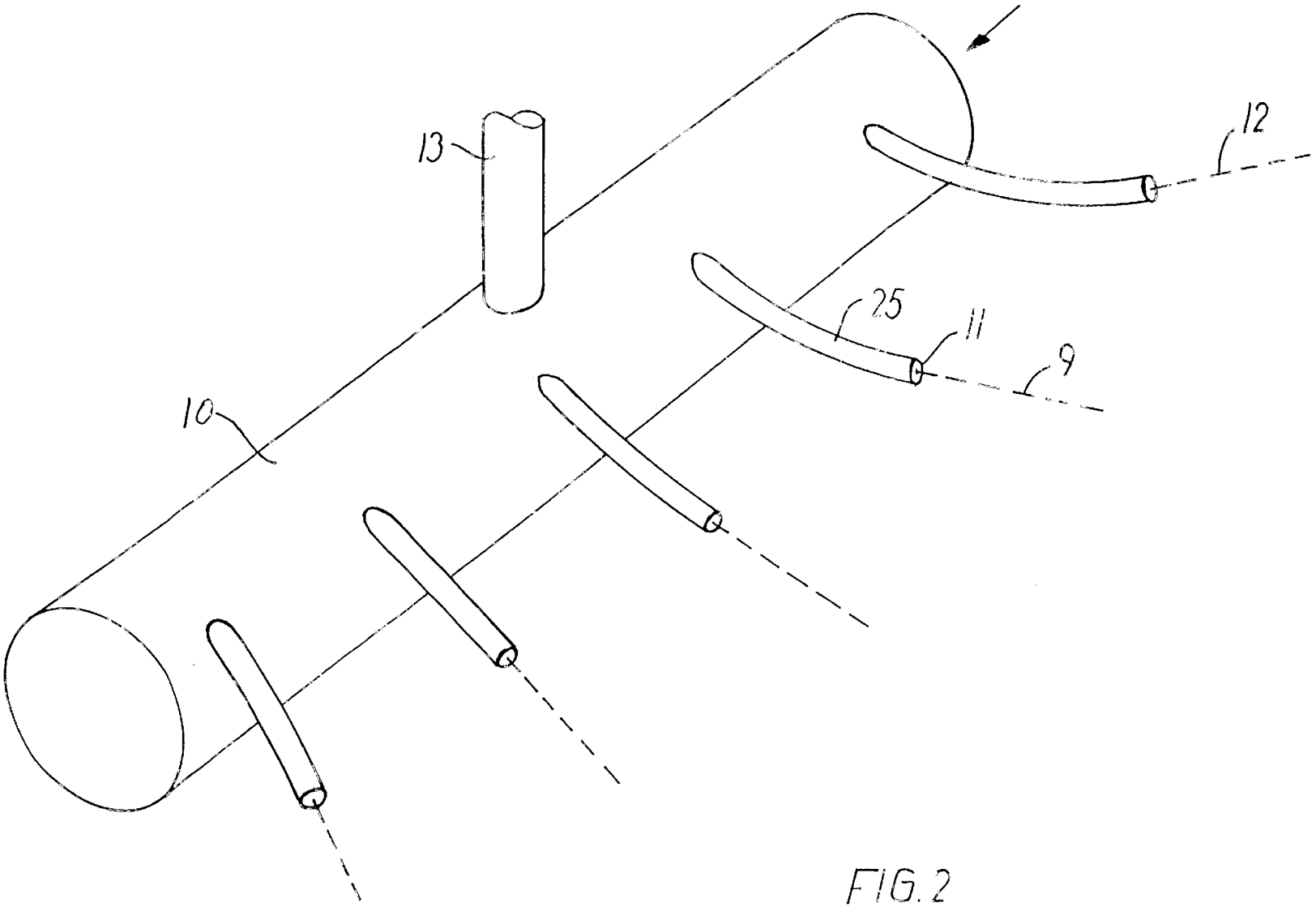
FIG. 2 is on a larger scale a perspective view of a side manifold for the road brine spreader in FIG. 1.

The side manifold 10 can be seen in detail in FIG. 2 which shows that the side nozzles 11 are placed at the end of tube sections 25 which are bent in such a way that the angle formed by the direction in which the side nozzles send out jets and a horizontal plane is increasing nozzle by nozzle along the side manifold towards the vehicle. The inmost jet angle is the biggest and the inmost nozzle is therefore sending the jet 12 farthest out towards the roadside 5. Contributing to this is moreover the fact that this jet is screened by the jets sent out by the other side nozzles.

By, as mentioned, letting the directions in which the jets are sent out form different angles with a horizontal plane, it is obtained that the water jets are evenly spread over the side track 24. The directions in which jets are sent out can advantageously be in or around a helicoid.

The tanker 1 furthermore comprises a control system for adjustment of the different operating parameters. To this system belong, in a first embodiment, a first detector 26 for registering the distance to the outermost water jet 12 and a second detector 27 for measuring the distance to the roadside 5.

Figure 3:
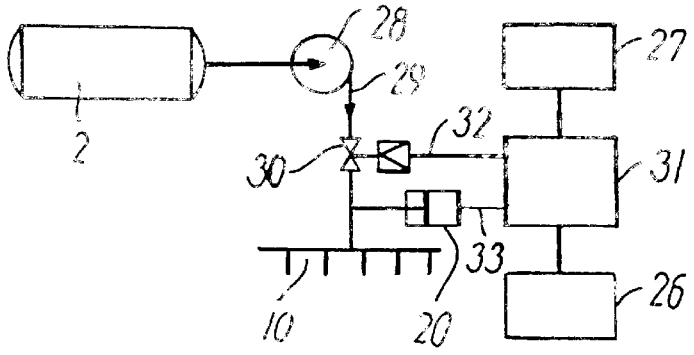
FIG. 3 is a schematic view of a first embodiment of a control system according to the invention.

Regulation takes place in the way shown in FIG. 3. The force pump 28 sends under pressure brine from the tank 2 via a pipe 29 to the side manifold 10. In the pipe 29 is inserted a pressure regulating valve 30 which is connected to a preprogrammed computer 31 via an electric wire 32. The cylinder 20 is connected to the computer 31 via a second electric wire 33.

The detectors 26 and 27 send input that represent the distances to the outermost water jet 12 and the roadside 5 respectively to the computer C which thereby is made to regulate the water pressure and the angular positions of the side manifold 10, which put the outermost water jet 12 in the wanted position in relation to the roadside 5. E.g. laser detectors, ultrasonic detectors, or camera detectors with an optical device for registering distances can be used as detectors.

Figure 4:
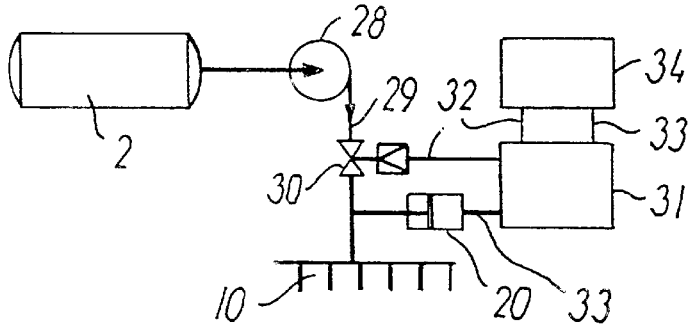
FIG. 4 is a schematic view of a second embodiment of a control system according to the invention.

FIG. 4 shows a second embodiment of the control system. This system mainly corresponds to the one in FIG. 3 and identical components are therefore similarly referenced. In this case however, the functions performed by the second and third detector in the first embodiment are assembled in one camera 34 with an optical device for simultaneously registering two distances.

Figure 5:
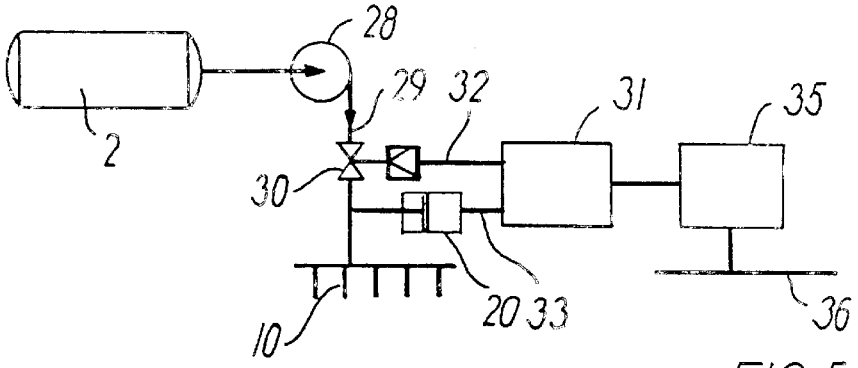
FIG. 5 is a schematic view of a third embodiment of a control system according to the invention.

FIG. 5 shows a third embodiment of the control system and identical components are, also in this case, designated by the same reference numerals as in FIG. 3. The computer 31 now receives the input from an ammeter 35 which measures the current intensity of the current passing through the outermost water jet 12 when it gets too close to a live wire 36 drawn along the roadside 5. By comparing with a predetermined reference value, the computer computes output to, just as in the two examples mentioned previously, put the outermost water jet 12 in the wanted position in relation to the roadside 5.

Figure 6:
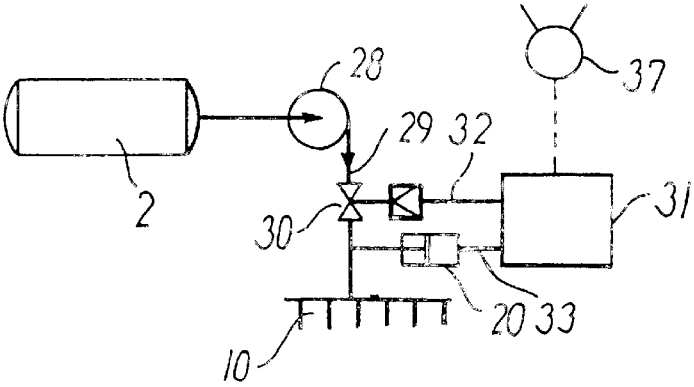
FIG. 6 is a schematic view of a fourth embodiment of a control system according to the invention.

FIG. 6 shows a fourth embodiment of the control system. Identical components are designated by the same reference numerals as in FIG. 3. This system is based on a Global Position System (GPS) where the computer 31 receives the input from a satellite 37. The system is used for adapting the brine quantity that is spread out to the local condition which e.g. might be a bridge, a curve, or a stretch of forest.

The road brine spreaders can function quite well with the above control systems that however do not comprise measurement and computation of the resultant wind velocity which is the resultant of the environmental wind velocity and driving speed.

However, the resultant wind velocity can, under certain circumstances, bend the water jets more or less, and thereby affect the course of the spreading.

In the case shown in FIG. 1, there is therefore an anemometer 38 for measuring the resultant wind velocity and submitting input that represent this wind velocity to the computer for computation of output for regulation of the different operating parameters.

What is claimed is:

1. A road brine spreader for driving along a roadway and within a border area, spreading brine out over the roadway in such a way that the brine is not spread over said border area, comprising:

a tank for containing a quantity of brine;

a plurality of central nozzles for spreading the brine over a central area of the roadway;

a plurality of side nozzles for spreading the brine over side areas of the roadway;

a force pump for pressuring and ejecting the brine through the nozzles; and a control system for regulating the quantity of the brine to be spread, the pressure by which the brine is ejected through the side nozzles, and the angular position of said side nozzles.

2. A road brine spreader according to claim 1 wherein the side nozzles are arranged to send out brine jets in a direction which, seen in horizontal projection, form an angle with the direction of travel of the spreader.

3. A road brine spreader according to claim 2, wherein it, on at least one side, has at least one elongated side manifold with the number of side nozzles placed with mainly equal mutual distances in the longitudinal direction of the side manifold, that the side manifold is pivotally mounted on the spreader about a mainly vertical axis, and that the spreader furthermore has an activator for turning the side manifold.

4. A road brine spreader according to claim 3, wherein the angle formed by the direction in which the side nozzles send out jets and a horizontal plane is increasing nozzle by nozzle along the side manifold.

5. A road brine spreader according to claim 1, Wherein the control system comprises at least one detector for registering the immediate distance between the spreader and preferably the outermost of the sent-out jet, a second detector for measuring the immediate distance between the spreader and the border area, and a preprogrammed computer for, from the respective detectors, receiving input signals which represent the values of the registered distances, and on the basis thereof, to compute the values of the size of the brine pressure and of the nozzle angle respectively where the difference between the measured values is equal to a predetermined reference value, and supply actuating means with output signals which are representative of the computed values for adjusting regulation means to positions where the brine pressure and the nozzle angle respectively correspond to the computed values.

6. A road brine spreader according to claim 5, wherein at least one detector is made as a camera with an optical device for simultaneously registering two distances.

7. A road brine spreader according to claim 6 wherein the computer of the control system is programmed to store the input signals received during driving and on the basis hereof, to give output signals which, on driving in the opposite direction, place the outermost brine jet in the wanted distance from the border area on this side of the road.

8. A road brine spreader according to claim 5, wherein the second detector and a third detector are made as one camera with an optical device for simultaneously registering distances.

9. A road brine spreader according to claim 5 wherein the control system comprises at least one detector for registering the values of environmental conditions, such as the relative strength and direction of the wind, and giving these as signals which represent the measured values to the preprogrammed computer in order to, together with the other received signals, compute the values of the size of the brine pressure and of the nozzle angle respectively where the difference between the measured values is equal to a predetermined reference value, and supply actuating means with output signals which are representative of the computed values for adjusting regulation means to positions where the brine pressure and the nozzle angle respectively correspond to the computed values.

10. A road brine spreader according to claim 1 wherein the control system comprises at least one, in use, live wire placed in the border area, an ammeter for registering the value of the current intensity between the wire and the outermost of the sent-out jets, and a preprogrammed computer for, from the ammeter, receiving input signals which represent the registered values of the current intensity, and on the basis thereof, computing the values of the size of the brine pressure and of the nozzle angle respectively where the registered value is equal to a predetermined reference value, and supply actuating means with output signals which are representative of the computed values for adjusting regulation means to positions where the brine pressure and the nozzle angle respectively correspond to the computed values.

11. A road brine spreader according to claim 1 wherein the control system comprises a Global Position System (GPS) for via a satellite registering the character of the present position of the vehicle, and a preprogrammed computer for, from this Global Position System, receiving input signals which represent the registered character of the position, and on the basis hereof, supplying actuating means with output signals which are representative of the value of a predetermined quantity spread brine per $m^2$ for the registered character for adjusting regulation means to positions where the nozzles are sending out this quantity.

* * * * *